US010575650B2

(12) United States Patent
Rodriguez

(10) Patent No.: US 10,575,650 B2
(45) **Date of Patent: *Mar. 3, 2020**

(54) PULLOUT SLEEPER SOFA WITH TRANSLATABLE SUPPORT FRAME

(71) Applicant: Louis Rodriguez, Bonito, CA (US)

(72) Inventor: Louis Rodriguez, Bonito, CA (US)

( * ) Notice: Subject to any disclaimer, the term of this patent is extended or adjusted under 35 U.S.C. 154(b) by 558 days.

This patent is subject to a terminal disclaimer.

(21) Appl. No.: 15/004,841

(22) Filed: Jan. 22, 2016

(65) Prior Publication Data

US 2016/0135605 A1 May 19, 2016

Related U.S. Application Data

(63) Continuation of application No. 13/917,589, filed on Jun. 13, 2013, now Pat. No. 9,241,576.

(60) Provisional application No. 61/659,299, filed on Jun. 13, 2012.

(51) Int. Cl.
*A47C 17/13* (2006.01)
*A47C 17/22* (2006.01)
*A47C 17/04* (2006.01)

(52) U.S. Cl.
CPC ..... *A47C 17/132* (2013.01); *A47C 17/04* (2013.01); *A47C 17/22* (2013.01); *A47C 17/13* (2013.01)

(58) Field of Classification Search
CPC ..... A47C 17/04; A47C 17/13; A47C 17/132; A47C 17/134; A47C 17/136; A47C 17/138; A47C 17/22; A47C 17/225; A47C 17/23; A47C 17/24; A47C 17/30
USPC ..... 5/13, 17, 18.1, 47
See application file for complete search history.

(56) References Cited

U.S. PATENT DOCUMENTS 456,915 A * 7/1891 Stevens ..... 5/147
1,078,908 A * 11/1913 Fischrupp ..... A47C 17/2076 5/13
1,166,315 A * 12/1915 Bell ..... A47C 17/1756 5/47
1,295,935 A 3/1919 Sowle
(Continued)

OTHER PUBLICATIONS

Web page for "E-Z Sleeper JH-613-27", Durfold Corporation,102 Upton Drive Jackson, MI 39209, http://www.durfold.com/index.htm, Registrant Durfold, Inc., 1 page, Copyright 2006.
(Continued)

*Primary Examiner* — Robert G Santos
(74) *Attorney, Agent, or Firm* — Stetina Brunda Garred and Brucker

(57) ABSTRACT

There is provided a sleeper sofa including a sofa frame, a main support frame, and a bed frame engageable with the sofa frame and main support frame. The sofa frame includes first and second arm portions, and a backrest portion extending therebetween. The main support frame is connected to at least one of the first and second arm portions to fixedly connect the main support frame to the sofa frame. The bed frame includes a first section and a second section pivotally connected to the first section via a hinge. The sleeper sofa further includes a guide plate defining an arcuate guide slot, which communicates with a guide post connected to the second section of the bed frame. The guide post travels in the guide slot to lower and raise the second section of the bed frame as the bed frame moves between the retracted and extended positions.

19 Claims, 5 Drawing Sheets

(56) References Cited

U.S. PATENT DOCUMENTS

| | | | | | |
|---|---|---|---|---|---|
| 1,800,496 | A * | 4/1931 | Bell | A47C 17/20 | 5/178 |
| 1,903,918 | A | 4/1933 | Henry et al. | | |
| 2,568,366 | A * | 9/1951 | Rosen | A47C 17/17 | 5/18.1 |
| 2,628,367 | A * | 2/1953 | Green | A47C 17/20 | 5/12.1 |
| RE23,955 | E * | 3/1955 | Green | A47C 17/20 | 5/12.1 |
| 2,730,727 | A | 1/1956 | Schneller | | |
| 2,738,520 | A * | 3/1956 | Murphy | A47C 17/20 | 5/47 |
| 3,002,198 | A | 10/1961 | Kaiser | | |
| 3,015,112 | A | 1/1962 | Wachsman | | |
| 3,877,087 | A | 4/1975 | Harty | | |
| 4,217,669 | A | 8/1980 | Ferrerman | | |
| 4,481,684 | A | 11/1984 | Hauck | | |
| 4,538,308 | A | 9/1985 | Grigoriev | | |
| 4,586,206 | A * | 5/1986 | Singer | A47C 17/225 | 5/12.1 |
| 4,737,996 | A | 4/1988 | Tiffany | | |
| 4,803,742 | A | 7/1989 | Rasnick et al. | | |
| 4,860,393 | A | 8/1989 | Schefthaler | | |
| 4,918,770 | A | 4/1990 | Hartline | | |
| 4,939,802 | A | 7/1990 | Lafer | | |
| 5,295,275 | A | 3/1994 | Sherman | | |
| 5,913,770 | A | 6/1999 | Tseng | | |
| 6,487,800 | B1 | 12/2002 | Evans et al. | | |
| 6,668,395 | B1 | 12/2003 | Chen | | |
| 6,904,628 | B2 | 6/2005 | Murphy et al. | | |
| 7,040,700 | B2 | 5/2006 | Duncan et al. | | |
| 7,383,596 | B2 | 6/2008 | James et al. | | |
| 7,945,974 | B2 | 5/2011 | Cabrera et al. | | |
| 8,225,439 | B2 | 7/2012 | Cabrera et al. | | |
| 8,321,971 | B2 | 12/2012 | Cabrera et al. | | |
| 8,881,325 | B2 * | 11/2014 | Cabrera | A47C 17/161 | 5/37.1 |
| 9,241,576 | B2 * | 1/2016 | Rodriguez | A47C 17/22 | |
| 9,468,304 | B2 * | 10/2016 | Cabrera | A47C 17/161 | |
| 2008/0092290 | A1 | 4/2008 | Cabrera | | |
| 2011/0214231 | A1 * | 9/2011 | Cabrera | A47C 17/161 | 5/13 |
| 2012/0210510 | A1 * | 8/2012 | Cabrera | A47C 17/161 | 5/48 |
| 2013/0145544 | A1 | 6/2013 | Cabrera et al. | | |
| 2013/0333110 | A1 * | 12/2013 | Rodriguez | A47C 17/22 | 5/13 |
| 2015/0040314 | A1 * | 2/2015 | Cabrera | A47C 17/161 | 5/18.1 |
| 2016/0135605 | A1 * | 5/2016 | Rodriquez | A47C 17/22 | 5/18.1 |

OTHER PUBLICATIONS

Web page for "Loveseat JH-613-48", Durfold Corporation, 102 Upton Drive Jackson, MI 39209, http:;;www.durfold.com/index.htm, Registrant Durfold, Inc., 1 page, Copyright 2006.

Web pages for "Sleepchair RP-1194", Durfold Corporation, 102 Upton Drive Jackson, MI 39209, http://www.durfold.com/index.htm, Registrant Durfold, Inc., 1 page, Copyright 2006.

"International Search Report," International Application No. PCT/US08/76892, (1 page), dated Dec. 1, 2008.

"PCT Written Opinion of the International Searching Authority," International Application No. PCT/US08/76892, (5 pages), dated Dec. 1, 2008.

Web pages for Converting Sofa-Bed ["How it Works": Sofa Position, TV Position and Bed Position], Bonsua Fine Sofa Beds and Sectionals, http://www.bonsua.com/, Registrant Muebles Bonsua, 5 pages, Copyright Unknown.

Web pages For Converting Sofa-Bed [Catalogue: "Devito": Sofa Position, TV Position and Bed Position], Dileto the Perfect Sofa Bed, http://dileto.com/vito1.html, http://www.dileto.com/vito2.html and http://www.dileto.com/vito3.html. Registrant Carlos Sanchez, 5 pages, Copyright Unknown.

* cited by examiner

PULLOUT SLEEPER SOFA WITH TRANSLATABLE SUPPORT FRAME

CROSS-REFERENCE TO RELATED APPLICATIONS

This application is a continuation of prior U.S. application Ser. No. 13/917,589, filed on Jun. 13, 2013, and issued as U.S. Pat. No. 9,241,576, which claims the benefit of U.S. Provisional Application No. 61/659,299, filed Jun. 13, 2012, the contents of which are expressly incorporated herein by reference.

STATEMENT RE: FEDERALLY SPONSORED RESEARCH/DEVELOPMENT

Not Applicable

BACKGROUND OF THE INVENTION

Technical Field of the Invention

The present invention relates generally to a sleeper sofa, and more particularly to a pullout sleeper sofa with a translatable support frame which includes only two pivoting sections which pivot about a single pivot axis.

Description of the Related Art

Sofa-beds have been in existence in the United States for many decades. One deficiency in prior art sofa-beds is that they are uncomfortable to sleep in. In particular, the bed frame of the sofa-bed may support a bed cushion via a system of springs. Unfortunately, the springs may not be sufficiently rigid to support a person lying down on the bed. Accordingly, the sleeper may complain of backache or an unpleasant sleep experience.

Another deficiency in prior art sofa-beds is that the bed frame is generally complex and unstable. In particular, the bed frame is typically folded into the sofa, and more particularly, into the base portion of the sofa where the person may sit. To fold the entire bed under the base portion of the sofa, the bed frame may have numerous pivoting parts to provide a pedestal to support the bed frame above the ground. Moreover, the bed frame may consist of three separate support portions. These support portions and pedestals may be folded upon each other in an accordion fashion and tucked into the base portion of the sofa which add to the instability and complexity of prior art sofa-beds. Such prior art devices may be complex to manufacture, heavy and not user friendly. Along these lines, use of the sleeper sofa may be difficult, not only for the intended user, but also for anyone trying to clean the sleeper sofa. For instance, many hotels and cruise lines include sleeper sofas in their rooms to take advantage of the dual functionality afforded by sleeper sofas. However, the cleaning crews in the hotels and cruise lines must clean the sleeper sofas by pulling out the bed portion for cleaning. In view of the large number of sleeper sofas included in a given hotel or cruise line, the process of unfolding each sleeper sofa during the cleaning process tends to be a very tedious and time-consuming endeavor.

In view of the foregoing, there is a need in the art for an improved sofa-bed which is specifically configured and adapted to transition between retracted and extended positions with greater ease that conventional, accordion-type sleeper sofas. These, and other advantages of the present invention, will be discussed in more detail below.

BRIEF SUMMARY OF THE INVENTION

In accordance with the present invention, there is provided a sleeper sofa that is easily transitional between a retracted position and an extended position. The sleeper sofa generally rolls or glides between the retracted and extended positions, and includes only two pivoting sections, thereby making deployment and storage of the bed portion simple, and easy-to-use.

According to one embodiment, the sleeper sofa includes a sofa frame, a main support frame, and a bed frame engageable with the sofa frame and main support frame. The sofa frame includes a first arm portion, a second arm portion, and a backrest portion extending between the first and second arm portions. The main support frame is connected to at least one of the first and second arm portions to fixedly connect the main support frame to the sofa frame. The bed frame includes a first section and a second section pivotally connected to the first section via a hinge. The sleeper sofa further includes a guide plate defining an arcuate guide slot, which communicates with a guide post connected to the second section of the bed frame. The guide post travels in the guide slot to lower and raise the second section of the bed frame as the bed frame moves between the retracted and extended positions.

According to one embodiment, the bed frame includes a forward section and a rearward section pivotally connected to the forward section, wherein the bed frame is selectively transitional between an extended position and a retracted position. The rearward section may pivot relative to the forward section and extend upwardly into the backrest cavity as the bed frame transitions from the extended position toward the rearward position. The bed frame may be configured to pivot about a single axis as the bed frame transitions between the extended and retracted positions.

According to another embodiment, the bed frame includes a pair of pivoting frame sections and defines a forward edge. The bed frame may be configured such that the forward edge moves away from a rear wall of the sofa frame as the bed frame transitions from the retracted position toward the extended position.

The first and second sections of the bed frame may be in generally co-planar alignment when the bed frame is in the extended position, and in an angular configuration when the bed frame is in the retracted position.

The sleeper sofa may further include a locking member engaged with the bed frame and the main support frame to restrict unwanted movement of the bed frame relative to the main support frame. The locking member may be selectively moved between an engaged, locked position and a disengaged, unlocked position as desired by the user. When in the engaged, locked position, the bed frame may not be moved relative to the sleeper frame. In the disengaged, unlocked position, the bed frame may be moved toward the retracted or extended positions. The locking member may be moved from the locked position toward the unlocked position by lifting an end portion of the bed frame relative to the main support frame.

The sleeper sofa may further include a frame support connected to the main support frame, wherein the frame support is configured to support the bed frame when the bed frame is in the extended position. The frame support may engage with the first section and/or the second section of the bed frame. The frame support may also engage with the hinge connecting the first and second sections.

The present invention is best understood by reference to the following detailed description when read in conjunction with the accompanying drawings.

BRIEF DESCRIPTION OF THE DRAWINGS

These as well as other features of the present invention will become more apparent upon reference to the drawings wherein.

Common reference numerals are used throughout the drawings and detailed description to indicate like elements.

DETAILED DESCRIPTION OF THE INVENTION

Figure 1:
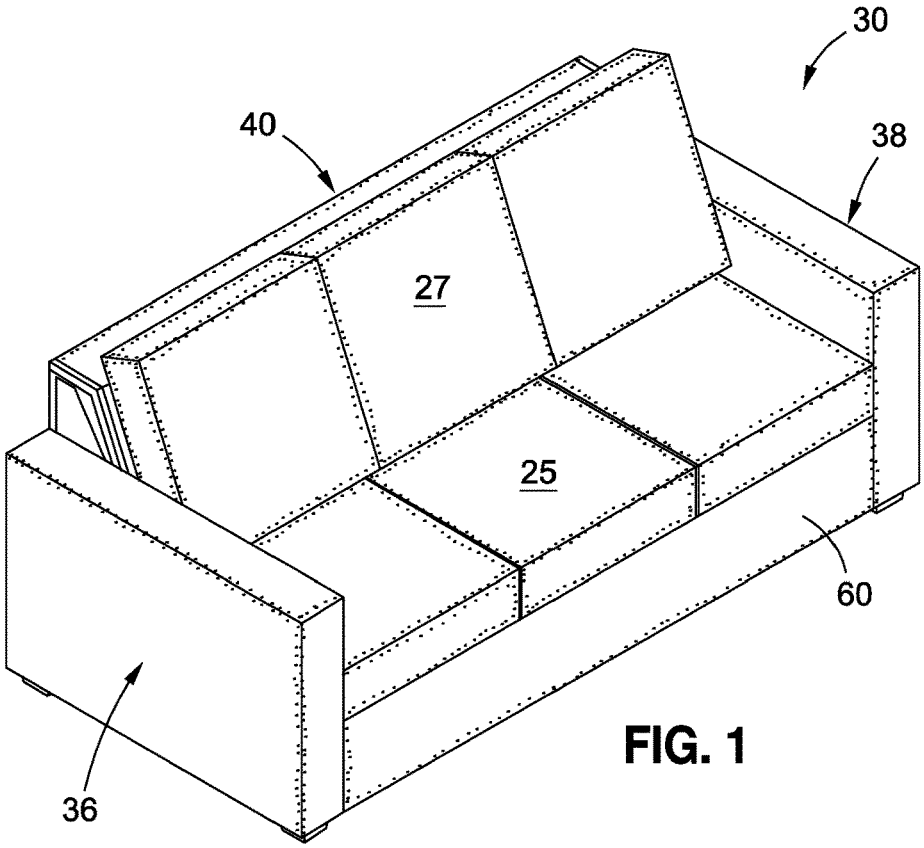
FIG. 1 is an upper perspective view of a sleeper sofa constructed in accordance with an embodiment of the present invention, the sleeper sofa depicted in a retracted position.

The detailed description set forth below in connection with the appended drawings is intended as a description of the presently preferred embodiments of the invention, and is not intended to represent the only form in which the present devices may be developed or utilized. It is to be understood, however, that the same or equivalent functions may be accomplished by different embodiments that are also intended to be encompassed within the spirit and scope of the invention. It is further understood that the use of relational terms such as first, second, and the like are used solely to distinguish one from another entity without necessarily requiring or implying any actual such relationship or order between such entities.

Referring now to the drawings, wherein the showings are for purposes of illustrating preferred embodiments of the present invention only, and not for purposes of limiting the same, there is shown a sleeper sofa 30 which includes a sofa frame 20, a main support frame 17 coupled to the sofa frame 20, and a bed frame 1 moveably connected to the main support frame 17. The bed frame 1 generally includes two pivotal sections 32, 34 (see FIGS. 5-7) which pivot about a hinge 9 between a retracted position (see FIG. 6), and an extended position (see FIG. 7). As will be explained in more detail below, in the retracted position, the two sections 32, 34 of the bed frame 1 assume an angled configuration relative to each other, whereas in the extended position, the two sections 32, 34 assume a generally co-planar position relative to each other. The sofa frame 20, main support frame 17, and bed frame 1 are all configured to allow for quick and easy transition of the bed frame 1 from the retracted position to the extended position, and vice versa. The pivotal movement of bed frame 1 about a single pivotal axis (e.g., defined by hinge 9) allows the bed frame 1 to easily transition between the retracted and extended positions, simply by pulling the bed frame 1 away from the sofa frame 20 (for extension) or pushing the bed frame 1 toward the sofa frame 20 (for retraction).

The drawings depict an exemplary embodiment of the sofa frame 20 and the main support frame 17. The sofa frame 20 includes a first arm portion 36, an opposing second arm portion 38, and a backrest portion 40 extending between the first and second arm portions 36, 38. Seat cushions 25 and back cushions 27 may be placed between the first and second arm portions 36, 38. The main support frame 17 includes a rear support member 42 and a pair of arm support members 44, 46 connected to opposed end portions of the rear support member 42. The rear support member 42 is positioned adjacent the backrest portion 40 of the sofa frame 20, while the pair of arm support members 44, 46 are connected to respective ones of the pair of first and second arm portions 36, 38. The pair of arm support members 44, 46 may be similarly configured to include a bracket 23 having apertures, slots or the like to accommodate nails, screws, rivets or other mechanical fasteners for securing the arm support members 44, 46 to the first and second arm portions 36, 38.

The main support frame 17 further includes a forward support member 48 and a pair of lateral support members 50, 52 extending from opposed end portions of the forward support member 48 to the rear support member 42. A pair of connector members 10 extend between respective ones of the lateral support members 50, 52 and the first and second arm support members 46, 44.

A plurality of legs 15 are connected to the main support frame 17 to elevate the main support frame 17 above a lower support surface, such as a floor. The plurality of legs 15 are preferably spaced about the main support frame 17 to provide balanced support to the main support frame 17. Furthermore, the exemplary embodiment shows four (4) legs 15, although fewer than four or more than four support legs 15 may be used, depending on the size, shape and configuration of the sleeper sofa 30.

One or more bed frame supports 5 is connected to the main support frame 17 to support the bed frame 1 when the bed frame 1 is in the extended position. The bed frame supports 5 are preferably positioned over the legs 15 to efficiently transfer the load from the bed frame supports 5 to the legs 15, and thereby mitigate load transfer through the main support frame 17.

Figure 5:
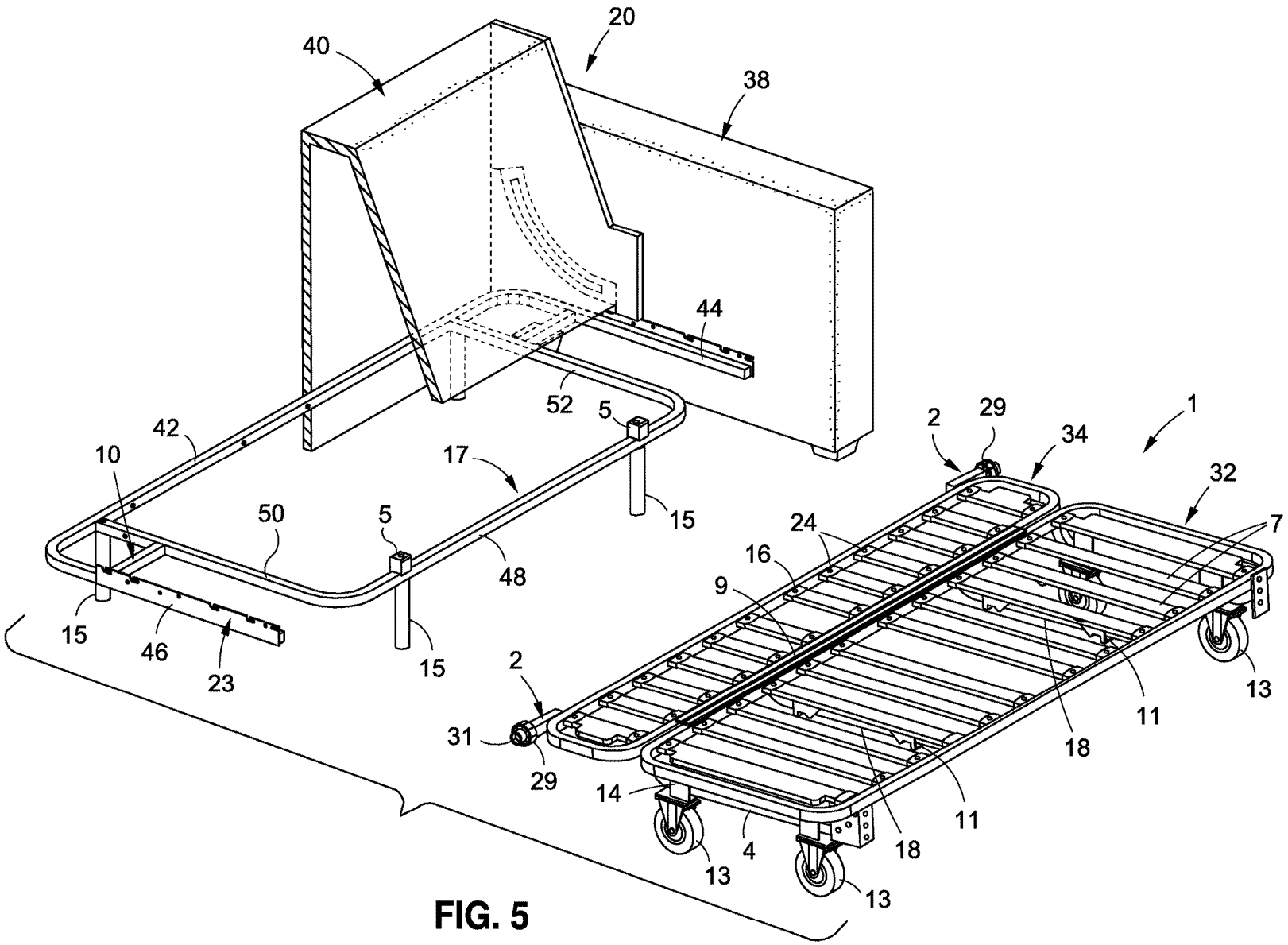
FIG. 5 is an upper perspective view of the main support frame, a portion of the sofa frame, and a moveable bed frame.

Referring now to FIG. 5, there is shown a partial view of the sofa frame 20, with the main support frame 17 being connected to the sofa frame 20. The bed frame 1 is also shown detached from the main support frame 17 and the sofa frame 20. With the particulars of the main support frame 17 and sofa frame 20 being described above, the following discussion will focus on the features of the bed frame 1.

The bed frame 1 includes the first section 32 and second section 34 pivotal relative to each other about the hinge 9. Each section 32, 34 is defined by a generally quadrangular frame having generally rounded corners. In the exemplary embodiment, the first section 32 includes a larger frame which defines a depth that is larger than the frame of the second section 34.

According to one embodiment, the first and second sections 32, 34 are pivotable relative to each other between a retracted position and an extended position. Due to the size and configuration of the first and second sections 32, 34, the bed frame 1 is pivotable about a single axis as the bed frame 1 pivots between the retracted and extended positions. Furthermore, the bed frame 1 is preferably configured and adapted such that the first and second sections 32, 34 pivot less than ninety degrees relative to each other as the bed frame 1 transitions between the retracted and extended positions. In this regard, the bed frame 1 does not fold with one section overlapping the other as the bed frame 1 transitions to the retracted position, which is distinct from conventional, "accordion-type" sleeper sofas.

The first and second sections 32, 34 also include a plurality of slats 7 which collectively form a deck and act as a support for a mattress disposed thereon. As shown, the slats 7 extend in a transverse direction across the respective frame. Each section 32, 34 include a plurality of slat supports 24 for connecting the slats 7 to the respective frame. The slats 7 may be connected to the slat supports 24 via rivets 16 or other mechanical fasteners known by those skilled in the art.

The bed frame 1 further includes a plurality of wheels 13 connected thereto to allow the bed frame 1 to be easily transitioned between the extended and retracted positions. According to one embodiment, the wheels 13 are connected to the first section 32 via respective metal wheel supports 14. The wheels 13 may define various sizes, although in a preferred embodiment, the wheels are approximately 5 inches in diameter.

The wheels 13 are preferably grouped in pairs, wherein the wheels 13 in a given pair are aligned along a common axis (i.e., roll along a common axis) which extends generally transverse to the first section 32. Furthermore, the wheels 13 in a given pair are connected via a wheel cart frame 4 which extends between the wheels 13 in the respective pair. Each wheel cart frame 4 connects a pair of wheels 13 together to facilitate steering of the bed frame 1 in and out of the sofa frame 20. Furthermore, the wheel cart frame 4 supports the weight of an individual sitting bed frame 1 when the bed frame 1 is in the retracted position, or lying on the bed frame 1, when the bed frame 1 is in the extended position. The wheels 13 allow the bed frame 1 to easily glide between the retracted and extended positions.

The underside of the bed frame 1 includes a frame support 18 and lock members 11 connected to the frame support 18. The lock members 11 lock the bed frame 1 in place relative to the main support frame 17 to mitigate unwanted movement of the bed frame 1. When the bed frame 1 is in the retracted position, at least one of the lock members 11 engaged with the forward support bar 48 of the main support frame 17. In this regard, the lock member 11 defines a contact surface which rests on the main support frame 17 when in the locked position and prevents transverse movement of the bed frame 1 relative to the main support frame 17. To unlock the bed frame 1 from the main support frame 17, the user lifts the front end portion of the first section 32, which causes disengagement of the lock member 11 from the main support frame 17. One or more restriction bars 3 may be connected to the first section 32 to keep the bed frame 1 in the generally horizontal position, i.e., to prevent a user from lifting the first section 32 too much when unlocking the bed frame 1 from the main support frame 17.

The sofa 30 further includes a movement assembly which aids in the movement of the bed frame 1 between the extended and retracted positions relative to the sofa frame 20 and main support frame 17. The movement assembly includes a guide post 2 and a guide wheel 29 connected to the guide post 2 via a fastener 31. The guide post 2 is connected to the second section 34 of the bed frame 1 and extends slightly outward therefrom in a lateral direction.

Figure 8:
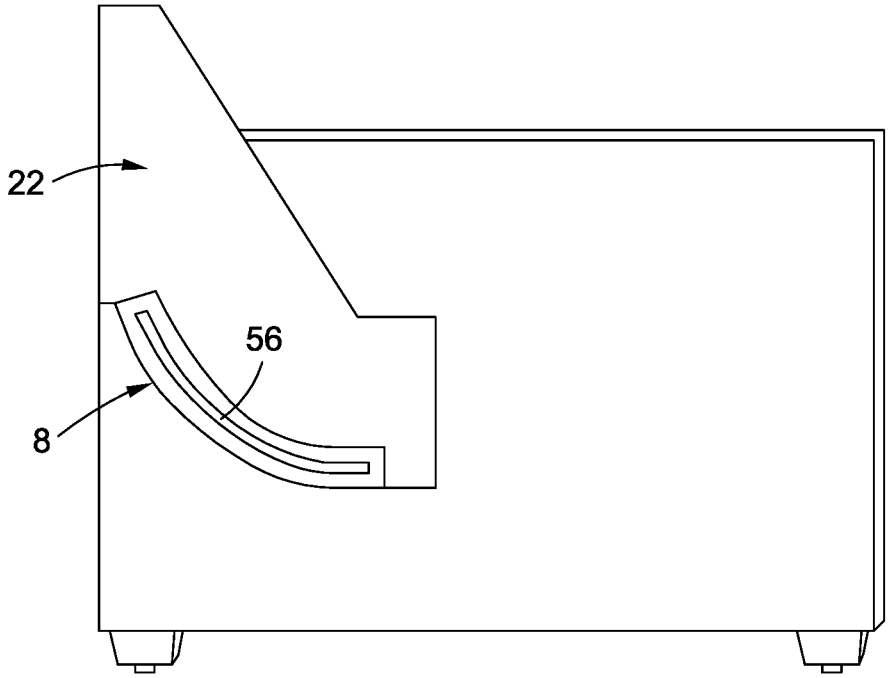
FIG. 8 is a side view of a guide plate connected to a portion of the sofa frame.
Figure 9:
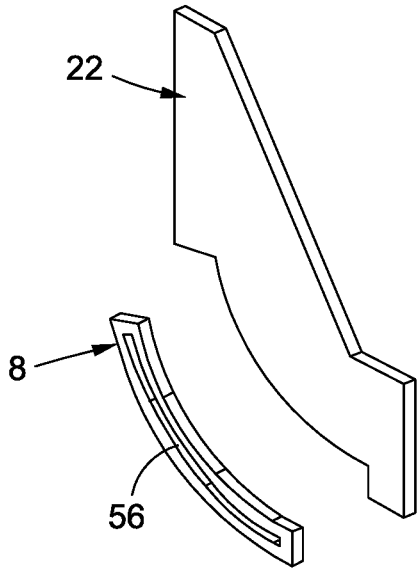
FIG. 9 is an exploded view of the guide plate and sofa frame depicted in FIG. 8.

Referring now to FIGS. 8-9, the movement assembly further includes a guide plate 8 having a guide slot 56 formed therein. The guide post 2 extends within the guide slot 56 and guides the guide post 2, and in turn, the second section 34 of the bed frame 1 during movement of the bed frame 1 between the retracted position and extended position. The guide slot 56 defines a generally arcuate configuration, which corresponds to the raising/lowering of the end portion of the second section 34 as the bed frame 1 transitions between the retracted and extended positions. More specifically, when the bed frame 1 moves from the retracted position to the extended position, the end portion 58 of the second section 34 is lowered. Conversely, when the bed frame 1 moves from the extended position to the retracted position, the end portion 58 of the second section 34 is raised.

Figure 6:
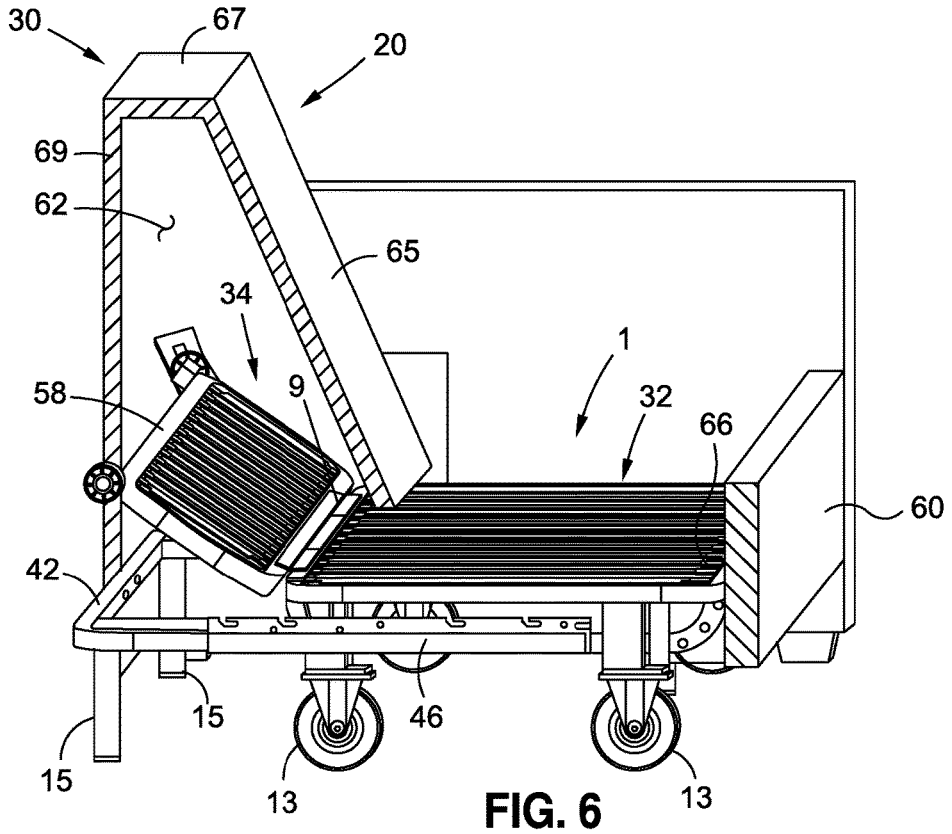
FIG. 6 is a side upper perspective view of the sleeper sofa in a retracted position.
Figure 7:
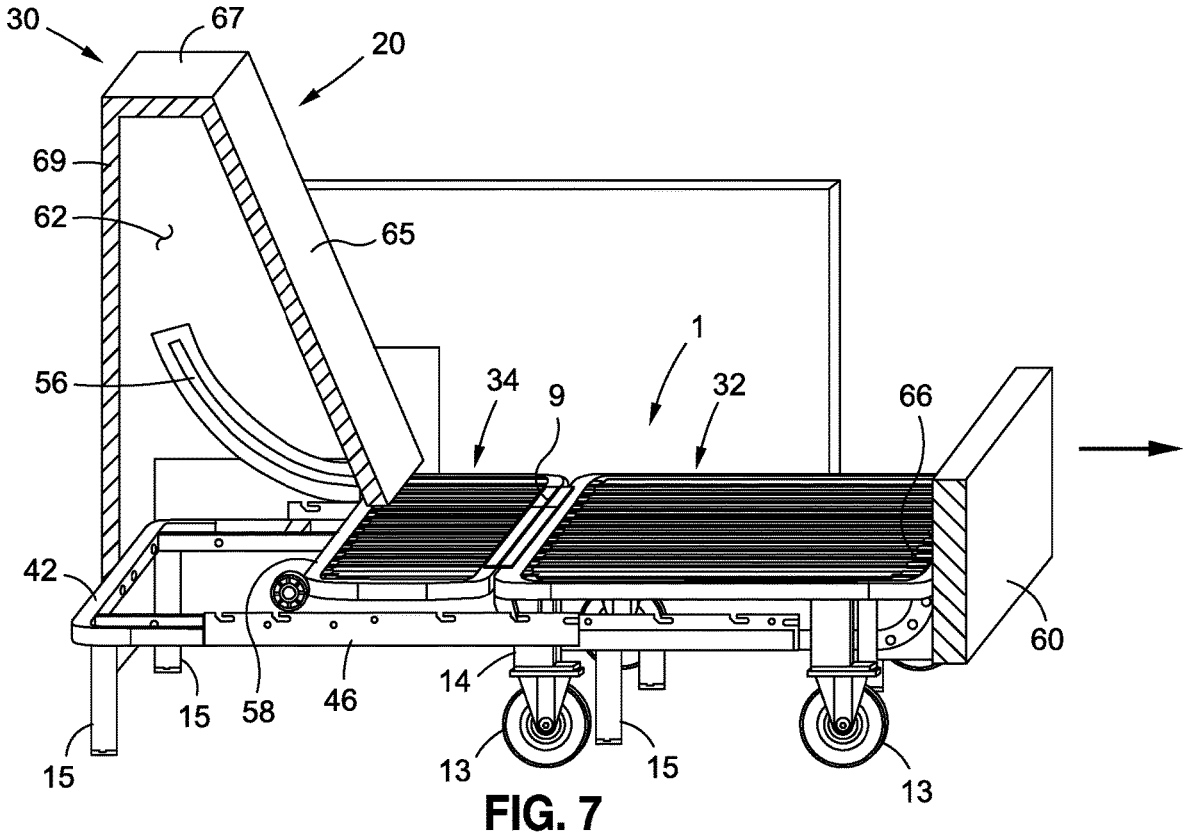
FIG. 7 is a side upper perspective view of the sleeper sofa in an extended position.

FIGS. 6 and 7 further show a front panel 60 to the sofa frame 20. The front panel 60 generally extends between the first and second arms portions 36, 38. The front panel 60 is connected to the bed frame 1 via front panel connectors.

With the basic structural features of the sleeper sofa 30 being described above, the following section offers a more detailed discussion of the transition of the sofa 30 between the retracted and extended position. FIG. 6 shows the sleeper sofa 30 in the retracted position, which is typically used for sitting on the sleeper sofa 30. When in the retracted position, the first and second sections 32, 34 of the bed frame 1 are angularly disposed relative to each other. The second section 34 extends upwardly into a cavity 62 in the sofa frame 20 behind the backrest portion 40 thereof. In particular, the cavity 62 may be at least partially defined by backrest wall 65, top wall 67 and rear wall 69. Furthermore, in the exemplary embodiment, the front panel 60 is substantially flush with the end faces of the first and second arm portions 36, 38. At least one lock member 11 is also engaged with the forward support member 48 of the main support frame 17 to prevent unwanted movement of the bed frame 1 when the bed frame 1 is in the retracted position (i.e., to keep the bed frame 1 from sliding forward).

Figure 2:
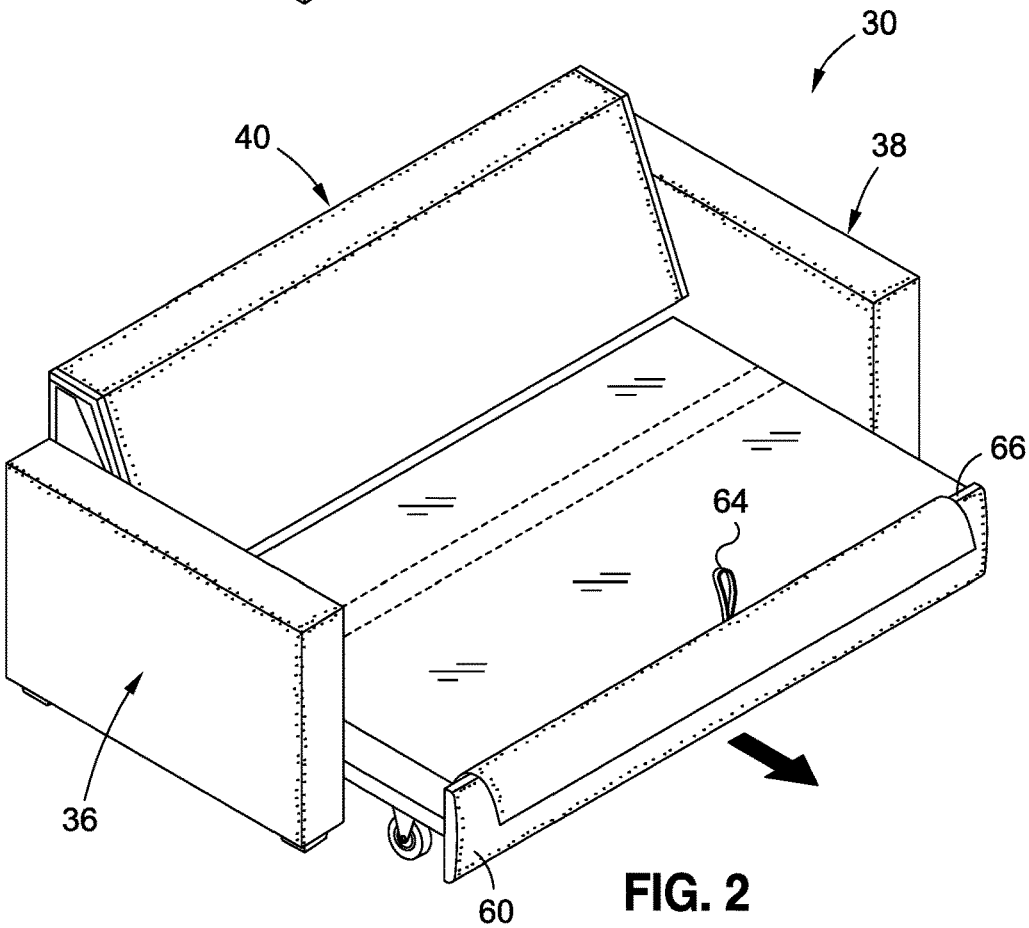
FIG. 2 is an upper perspective view of the sleeper sofa with cushions removed and the sleeper sofa in an extended position.
Figure 3:
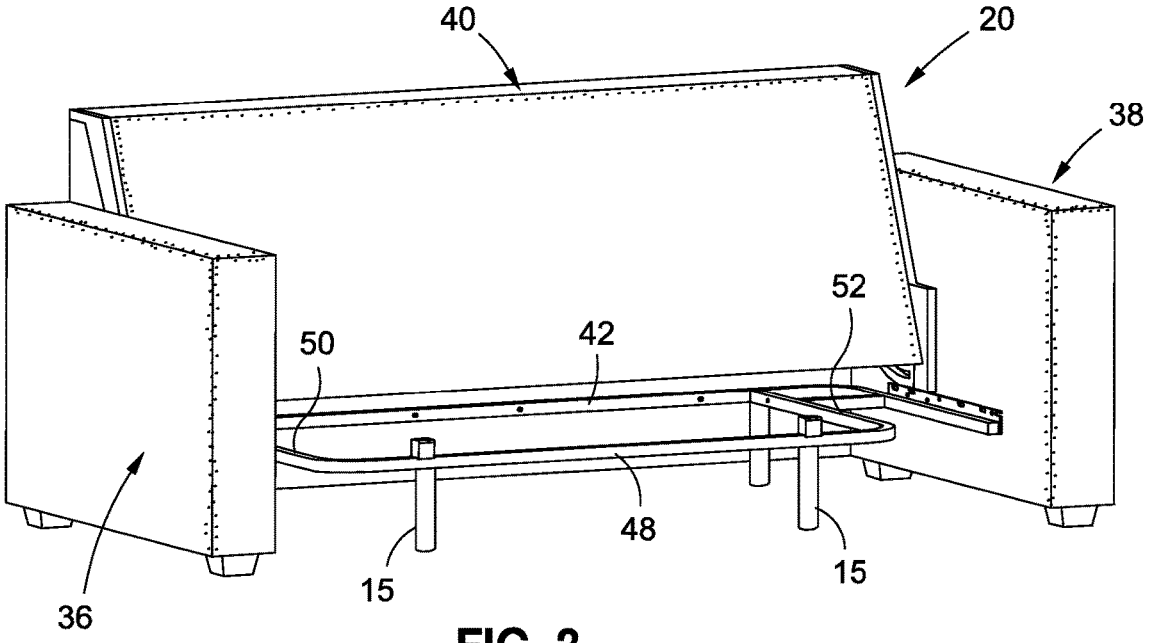
FIG. 3 is an upper perspective view of a main support frame connected to a sofa frame.
Figure 4:
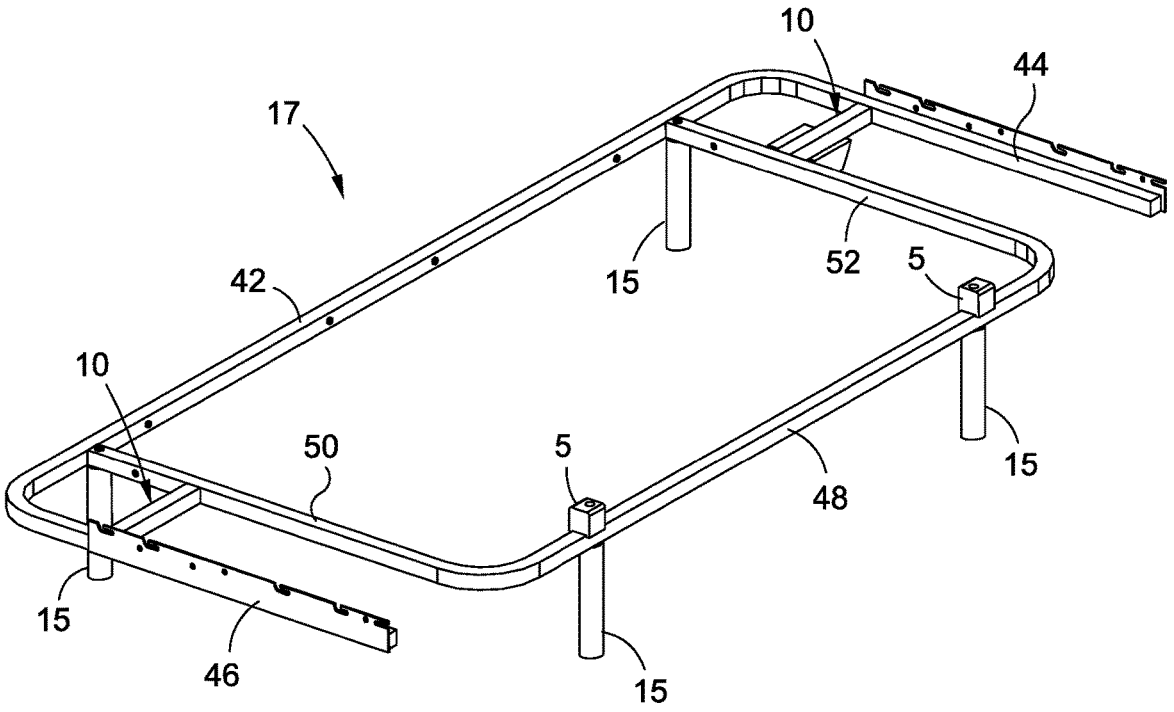
FIG. 4 is an upper perspective view of the main support frame depicted in FIG. 3.

To unlock the bed frame 1, the user lifts on the forward end thereof to disengage the lock member 11 from the main support frame 17. The FIG. 2 shows a strap 64 which may be disposed adjacent the forward end 66 to aid in lifting the forward end portion 66. The bed frame 11 is pulled forward slightly and then the user lowers the forward end portion 66 so all of the wheels 13 are engaged with the floor surface. The user may then pull out the forward end portion 66 until the bed frame 1 is in the extended position. In the completely extended position, the first and second sections 32, 34 of the bed frame 1 are generally coplanar relative to each other. Furthermore, the guide post 2 reaches a terminal end of the guide slot 56 to prevent further advancement of the bed frame 1.

With the bed frame 1 in the extended position, a user(s) may lie on the sleeper sofa in a manner similar to a bed. The specific size and configuration of the sleeper sofa may allow the user(s) to lie on the bed in several different positions. For instance, the user may lie in a direction substantially perpendicular to the direction of extension of the bed frame 1 (i.e., with the user's head and feet disposed adjacent the first and second arm rest portions 36, 38). In this regard, the bed frame 1 may not require a great deal of extension from the retracted position to accommodate the user. This may be desirable for hotels and cruise ships, where excess space in front of the sleeper sofa may not be readily available. Alternatively, it is understood that various embodiments of the sleeper sofa 30 may allow the user to lie in a direction substantially parallel to the direction of extension of the bed frame 1 from the retracted position to the extended position (i.e., with lying in a position wherein the user's head or feet extends away from the sofa frame 20).

To move the bed frame 1 back to the retracted position from the extended position, the user simply pushes the bed frame 1 back toward the sofa frame 20. As this occurs, the guide post 2 moves back through the guide slot 56, thereby lifting the end portion 58 of the second section 34 of the bed frame 1. To complete the transition to the retracted position, the user lifts the forward end portion 66 of the first section 32 to engage the lock member 11 with the forward bar of the main support frame 17.

Thus, the bed frame 1 easily transitions between the retracted and extended positions via a smooth gliding motion which is facilitated by the wheels 13. Unlike conventional sleeper sofas, which generally include a complex, folded, articulating skeleton, the sleeper sofa 30 described herein is simple and easy-to-use. The only articulating motion is the present sleeper sofa 30 is the pivoting movement of the second section 34 relative to the first section 32 as the bed frame 1 moves between the retracted and extended positions. Such pivotal movement is typically concealed within the sofa frame 20. Indeed, the first section 32 of the bed frame 1 remains substantially in a common plane as it transitions between the retracted and extended positions. In this regard, the bed frame 1 is not folded to overlap with itself, as is common in conventional sleeper sofas. Therefore, the sleeper sofa 30 is very simple and easy-to-use.

The ease in transitioning the sleeper sofa 30 between the retracted and extended positions may facilitate cleaning of the sleeper sofa, as the bed portion may be easily accessed through the simple transition of the sofa from the retracted position to the extended position. After the portion is cleaned, the sleeper sofa may be easily transitioned from the extended position back to the retracted position. Thus, the ease in cleaning the sleeper sofa 30 may make various implementations of the sleeper sofa 30 suitable for the hotel industry and cruise industry, where sleeper sofas are readily used and cleaned on a regular basis.

Furthermore, the likelihood of injury associated with operation of the sleeper sofa 30 is significantly reduced as compared to conventional sleeper sofas due to substantially concealed nature of the pivotal movement, and the simple transitional movement of the bed frame between the retracted and extended positions. Moreover, the weight of the bed frame 1 is substantially supported throughout the transition between the retracted and extended positions, as the wheels 13 remain on the floor during most of the transition. The only lifting that occurs is the minimal lifting of the forward end portion 66 to unlock the bed frame 1 from the main support frame 17. Otherwise, the bed frame 1 is supported by the wheels 17 and not by the user.

FIG. 1 depicts an exemplary embodiment of a three cushion sleeper sofa incorporating the features described herein. Those skilled in the art will readily understand that the dimensional information presented in the Figures are exemplary in nature only and are not intended to limit the scope of the present invention. Along these lines, other furniture pieces defining different dimensional characteristics may be fabricated which incorporate one or more aspects of the present invention described herein.

According to one embodiment, the sleeper sofa may define a chaise-like configuration, which is adapted to include the features described herein. It is contemplated that the height of one of the arm sections may be reduced such that is it flush with the top surface of the mattress pad.

Additional modifications and improvements of the present invention may also be apparent to those of ordinary skill in the art. Thus, the particular combination of components and steps described and illustrated herein is intended to represent only certain embodiments of the present invention, and is not intended to serve as limitations of alternative devices and methods within the spirit and scope of the invention.

What is claimed is:

1. A convertible sleeper sofa comprising:

a sofa frame having a pair of arm portions in opposed relation to each other and a backrest portion extending between the pair of arm portions and defining a backrest cavity;

a bed frame operatively coupled to the sofa frame and including a forward section and a rearward section pivotally connected to the forward section, the bed frame being selectively transitional between an extended position and a retracted position relative to the sofa frame, the rearward section pivoting relative to the forward section and extending upwardly into the backrest cavity as the bed frame transitions from the extended position toward the retracted position, the bed frame being configured to pivot about a single axis as the bed frame transitions between the extended and retracted positions; and a first wheel and a second wheel, each being coupled to the forward section of the bed frame, the first and second wheels being arranged such that the first wheel is positioned closer to the rearward section than the second wheel and both the first and second wheels being configured to roll along a common support surface as the bed frame transitions between the extended and retracted positions.

2. The convertible sleeper sofa recited in claim 1, further comprising a main support frame connected to the sofa frame and configured to be engaged with the bed frame in the extended and retracted positions for supporting the bed frame.

3. The convertible sleeper sofa recited in claim 2, further comprising:

an extended locking member coupled to the bed frame and engageable with the main support frame when the bed frame is in the extended position to connect the bed frame to the main support frame; and a retracted locking member coupled to the bed frame and engageable with the main support frame when the bed frame is in the retracted position to connect the bed frame to the main support frame.

4. The convertible sleeper sofa recited in claim 3, wherein the main support frame includes a rear support member coupled to the sofa frame and a forward support member spaced from the rear support member, the extended locking member being engaged with the forward support member when the bed frame is in the extended position, the retracted locking member being engaged with the forward support member when the bed frame is in the retracted position.

5. The convertible sleeper sofa recited in claim 1, wherein the forward section and rearward section of the bed frame are in generally co-planar alignment when the bed frame is in the extended position, and the rearward section is disposed in an angled position relative to the forward section when the bed frame is in the retracted position.

6. The convertible sleeper sofa recited in claim 5, wherein the rearward section pivots less than ninety degrees relative to the forward section as the bed frame transitions between the extended and retracted positions.

7. The convertible sleeper sofa recited in claim 1, further comprising:

a guide plate coupled to the sofa frame and including an arcuate guide slot formed therein; and a guide post connected to the bed frame and disposed within the guide slot and traversing within the guide slot as the bed frame transitions between the extended and retracted positions.

8. The convertible sleeper sofa recited in claim 1, wherein the sofa frame includes a backrest wall and a rear sofa wall at least partially defining the backrest cavity, the rearward section of the bed frame extending between the backrest wall and the rear sofa wall when the bed frame is in the retracted position.

9. The convertible sleeper sofa recited in claim 1, wherein the forward section of the bed frame is configured to remain in a generally horizontal configuration as the sleeper sofa transitions between the extended and retracted positions.

10. The convertible sleeper sofa recited in claim 1, wherein the rearward section is translatably and pivotally coupled to the sofa frame.

11. A convertible sleeper sofa comprising:

a sofa frame having a pair of arm portions in opposed relation to each other and a rear wall extending between the pair of arm portions;

a bed frame operatively coupled to the sofa frame and including a pair of pivoting frame sections and defining a forward edge, the bed frame being coupled to the sofa frame and transitional relative to the sofa frame between a retracted position and an extended position, the forward edge moving away from the rear wall of the sofa frame as the bed frame transitions from the retracted position toward the extended position, the bed frame being configured to pivot about a single axis; and a first wheel and a second wheel, each being coupled to the forward section of the bed frame, the first and second wheels being arranged such that the first wheel is positioned closer to the rearward section than the second wheel and both the first and second wheels being configured to roll along a common support surface as the bed frame transitions between the extended and retracted positions.

12. The convertible sleeper sofa recited in claim 11, wherein one of the pair of pivoting frame sections is translatably and pivotally coupled to the sofa frame.

13. The convertible sleeper sofa recited in claim 11, wherein the pivoting frame sections are configured to pivot no more than ninety degrees relative to each other as the bed frame transitions between the retracted and extended positions.

14. The convertible sleeper sofa recited in claim 11, further comprising:

a main support frame connected to the sofa frame and configured to be engaged with the bed frame in the extended and retracted positions for supporting the bed frame;

an extended locking member coupled to the bed frame and engageable with the main support frame when the bed frame is in the extended position to connect the bed frame to the main support frame; and a retracted locking member coupled to the bed frame and engageable with the main support frame when the bed frame is in the retracted position to connect the bed frame to the main support frame.

15. The convertible sleeper sofa recited in claim 14, wherein the main support frame includes a rear support member coupled to the sofa frame and a forward support member spaced from the rear support member, the extended locking member being engaged with the forward support member when the bed frame is in the extended position, the retracted locking member being engaged with the forward support member when the bed frame is in the retracted position.

16. The convertible sleeper sofa recited in claim 11, wherein the pair of pivoting frame sections of the bed frame are in generally co-planar alignment when the bed frame is in the extended position, and an angled position relative to each other when the bed frame is in the retracted position.

17. The convertible sleeper sofa recited in claim 11, further comprising:

a guide plate coupled to the sofa frame and including an arcuate guide slot formed therein; and a guide post connected to the bed frame and disposed within the guide slot and traversing within the guide slot as the bed frame transitions between the extended and retracted positions.

18. A convertible sleeper sofa comprising:

a sofa frame having a pair of arm portions in opposed relation to each other and a backrest portion extending between the pair of arm portions and defining a backrest cavity;

a bed frame operatively coupled to the sofa frame and including a forward section and a rearward section pivotally connected to the forward section, the bed frame being selectively transitional between an extended position and a retracted position relative to the sofa frame, the rearward section pivoting relative to the forward section and extending upwardly into the backrest cavity as the bed frame transitions from the extended position toward the rearward position, the bed frame being configured to pivot about a single axis as the bed frame transitions between the extended and retracted positions;

a main support frame connected to the sofa frame and configured to be operatively coupled with the bed frame in the extended and retracted positions for supporting the bed frame;

a plurality of extended locking members coupled to the bed frame and engageable with the main support frame when the bed frame is in the extended position to connect the bed frame to the main support frame;

a plurality of retracted locking members coupled to the bed frame and engageable with the main support frame when the bed frame is in the retracted position to connect the bed frame to the main support frame; and a first wheel and a second wheel, each being coupled to the forward section of the bed frame, the first and second wheels being arranged such that the first wheel is positioned closer to the rearward section than the second wheel and both the first and second wheels being configured to roll along a common support surface as the bed frame transitions between the extended and retracted positions;

wherein the main support frame includes a rear support member coupled to the sofa frame and a forward support member spaced from the rear support member, the extended locking members being directly engaged with the forward support member when the bed frame is in the extended position, the retracted locking members being directly engaged with the forward support member when the bed frame is in the retracted position.

19. The convertible sleeper sofa recited in claim 18, wherein the rearward section pivots less than ninety degrees relative to the forward section as the bed frame transitions between the extended and retracted positions.

* * * * *